US005457845A

United States Patent [19]

Higgins et al.

[11] Patent Number: 5,457,845

[45] Date of Patent: Oct. 17, 1995

[54] APPARATUS TO REFURBISH CARPET TILES

[75] Inventors: Kenneth B. Higgins, LaGrange, Ga.; Charles E. Willbanks, Spartanburg, S.C.

[73] Assignee: Milliken Research Corporation, Spartanburg, S.C.

[21] Appl. No.: 955,326

[22] Filed: Oct. 1, 1992

[51] Int. Cl.[6] ..... D06B 1/02; D06P 3/82

[52] U.S. Cl. ..... 15/302; 15/306.1; 68/205 R; 68/20

[58] Field of Search ..... 15/302, 306.1; 68/205 R, 20; 26/15 R; 198/725, 731, 733; 28/100; 8/151

[56] References Cited

U.S. PATENT DOCUMENTS

| | | | |
|---|---|---|---|
| 2,816,647 | 12/1957 | Ruth | 198/725 |
| 3,348,660 | 10/1967 | Baker | 198/729 |
| 4,109,352 | 8/1978 | Buthe | 26/15 R |
| 4,339,856 | 7/1982 | Sando et al. | 68/205 R |
| 4,371,371 | 2/1983 | Smrekar | 68/205 R |
| 4,434,632 | 3/1984 | McCollough, Jr. | 68/205 R |
| 4,614,096 | 9/1986 | Beretta | 68/205 R |
| 4,649,606 | 3/1987 | Fay | 26/15 R |
| 4,926,514 | 5/1990 | Leuenberger | 68/205 R |
| 4,967,456 | 11/1990 | Sternlieb et al. | 68/205 R |
| 5,117,657 | 6/1992 | Tissari | 68/205 R |
| 5,193,363 | 3/1993 | Petty | 68/205 R |

*Primary Examiner*—David Scherbel
*Assistant Examiner*—Patrick F. Brinson
*Attorney, Agent, or Firm*—Terry T. Moyer; Earle R. Marden

[57] ABSTRACT

Apparatus to refurbish cut and/or loop pile products, including carpet tiles, by conveying the product to be refurbished by a high pressure water or cleaning liquid dispensing device which has a high pressure liquid outlet supplying such water or cleaning liquid against the product to be refurbished at a pressure in the range of 200–2000 p.s.i.g.

2 Claims, 3 Drawing Sheets

APPARATUS TO REFURBISH CARPET TILES

This invention relates generally to the refurbishment of pile carpet, especially carpet tiles, to provide extended wear life without a detrimental affect on the surroundings due to a reduced aesthetic effect by the existing pile carpet due to dirt and/or matting of the pile on the face of the tile.

In the past it has been necessary to replace pile carpet when it became dirty, develops a change in texture in some areas and/or is matted down due to traffic and/or furniture thereon. The replacement of such carpet is expensive due to the price of new carpet and has to be matched to the existing environment. This unnecessary replacement of carpet, especially carpet tiles, in commercial establishments is an expense which, if it can be avoided, will free up money which can be used for other desirable purposes.

Therefore, it is an object of the invention to provide a method and apparatus to refurbish cut and loop pile carpet and eliminate the cost of replacement of such tile with new carpet.

Other objects and advantages of the invention will become readily apparent as the specification proceeds to describe the invention with reference to the accompanying drawings, in which.

Figure 1:
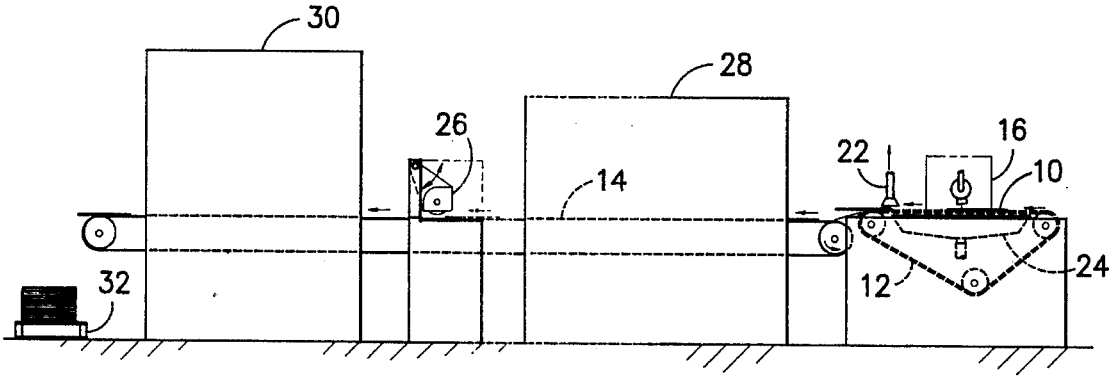
FIG. 1 is an overall schematic representation of the carpet tile refurbishing system.
Figure 2:
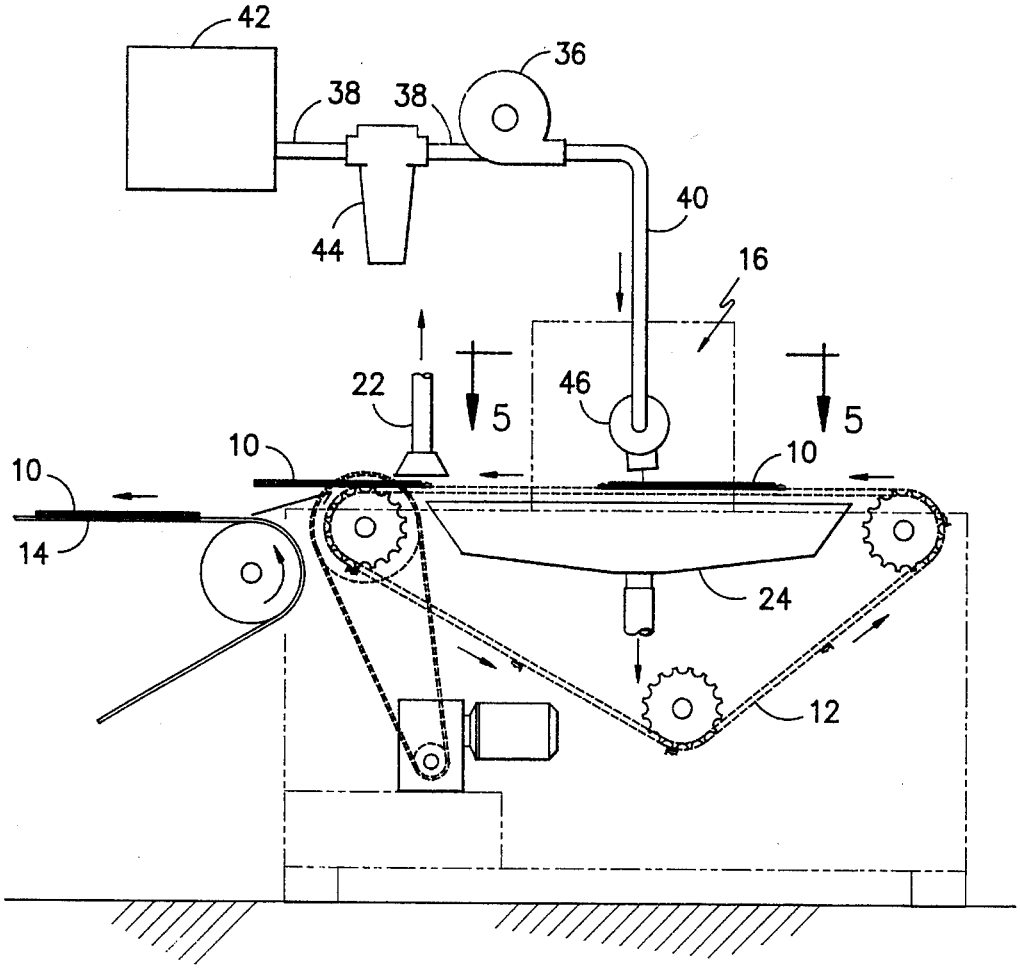
FIG. 2 is a blown-up view of the carpet tile washing section of the system shown in FIG. 1.

Looking now to the drawings and in particular to FIGS. 1 and 2 a system is shown wherein pile carpet tiles 10 are refurbished. As briefly discussed before, the invention is directed in general to pile carpet, cut or loop, but is primarily directed to carpet tiles since these are used in commercial establishments and generally receive more wear due to traffic by pedestrians thereon and therefore tend to mat and get dirty quicker than residential carpet. The carpet tiles are usually in 18" squares and have pile yarns, cut or loop, like that shown in U.S. Pat. No. 4,371,576. As shown in FIG. 1 the carpet tiles 10 are treated on cooperating conveyors 12 and 14 but, obviously, one continuous conveyor could be used, if desired.

Briefly the system of FIGS. 1 and 2 will be described with the description being directed to a cut pile carpet tile 10. The dirty and/or matted carpet tile 10 is placed on the conveyor 12 where it is initially conveyed under a source of high pressure cleaning liquid or water, generally designated 16, whereat liquid, such as water, is supplied at a pressure within the range of 200–2000 p.s.i.g., preferably 300–1200 p.s.i.g. In the preferred form of the invention the liquid is supplied at a pressure of about 800 p.s.i.g. from the nozzles 18 and impinges on the carpet tile. It is contemplated that an elongated slot can be used rather than the disclosed nozzles 18 so long as the liquid pressure is maintained in the desired range. The high pressure liquid from the jets clean the dirt from the surface and between the yarns 20 of the carpet tile while at the same time removing the twist from the yarn and causing them to upright themselves. From the high pressure water source 16 the carpet tiles pass under a vacuum extractor 22 to remove water therefrom. Also located under the conveyor 12 is a water sump collector 24 to recover the water from the water source 16.

Since the high pressure water from the nozzle 18 removes the twist from the yarn 20 if the yarn 20 has twist therein or lifts and straightens yarn which has no or very little twist therein the surface of the upright yarns tends to be uneven. So the carpet tiles, after being deposited on the conveyor 14 are conveyed to a shear 26, after passing through a dryer 28, to even out the pile height of the yarns 20. If desired, the carpet tiles 10 can be over-printed or brightened by a dye machine 30 prior to being collected on a pallet 32. The dye machine can be of any suitable type but is preferably a computer controlled jet type such as that shown and disclosed in U.S. Pat. No. 4,993,242.

The above description is directed to a cut pile carpet but obviously the above system can be employed to clean and de-mat a loop pile carpet tile. One approach, not shown, includes cutting of the loops in the loop pile product and then treating it as a cut pile carpet tile as described above. Another approach is to pass the loop pile carpet tile under the high pressure water source as described above but pivot the shear 26, as shown, upwards away from the conveyor 14 as it passes downstream.

To properly maintain the carpet tiles in spaced relationship a plurality of slats 34 are connected to the conveyor 12 and/or 14. As the tiles 10 are conveyed under the high pressure water source a chambered guide bar 36 mounted on both sides of the conveyor guides the carpet tile into position under the water source 16 as the slats 34 pass under the guide bars. This same arrangement can be used on the conveyor 14 as the carpet tiles pass under the shear 26 and the dye machine 30. The slots 34 and the guide bar 36 serve the further function of maintaining the fibers on the edges of the tile in an upright condition as the liquid impinges thereon so that further operations downstream will treat them as well as the other yarn in the body of the tile. This prevents the edge fibers from being bent over and giving a ragged appearance to the carpet tile after cleaning thereof.

Figure 3:
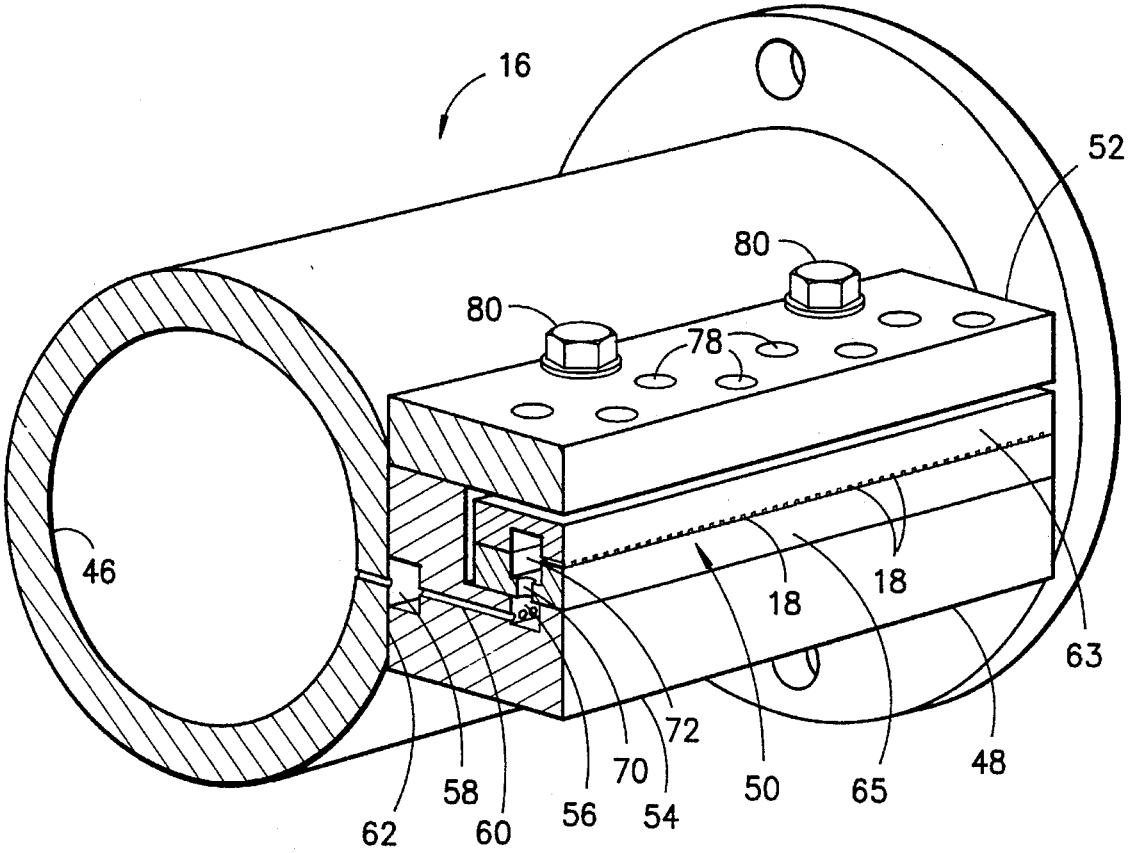
FIG. 3 is a perspective view of the carpet tile water applicator used in the system of FIGS. 1 and 2.
Figure 4:
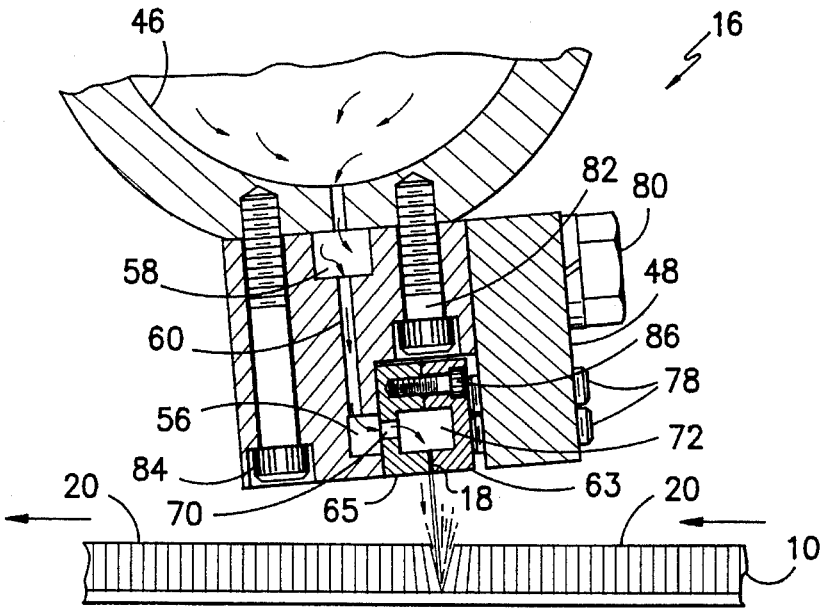
FIG. 4 is a cross-section view showing the water applicator of FIG. 4 in position to wash a carpet tile.
Figure 5:
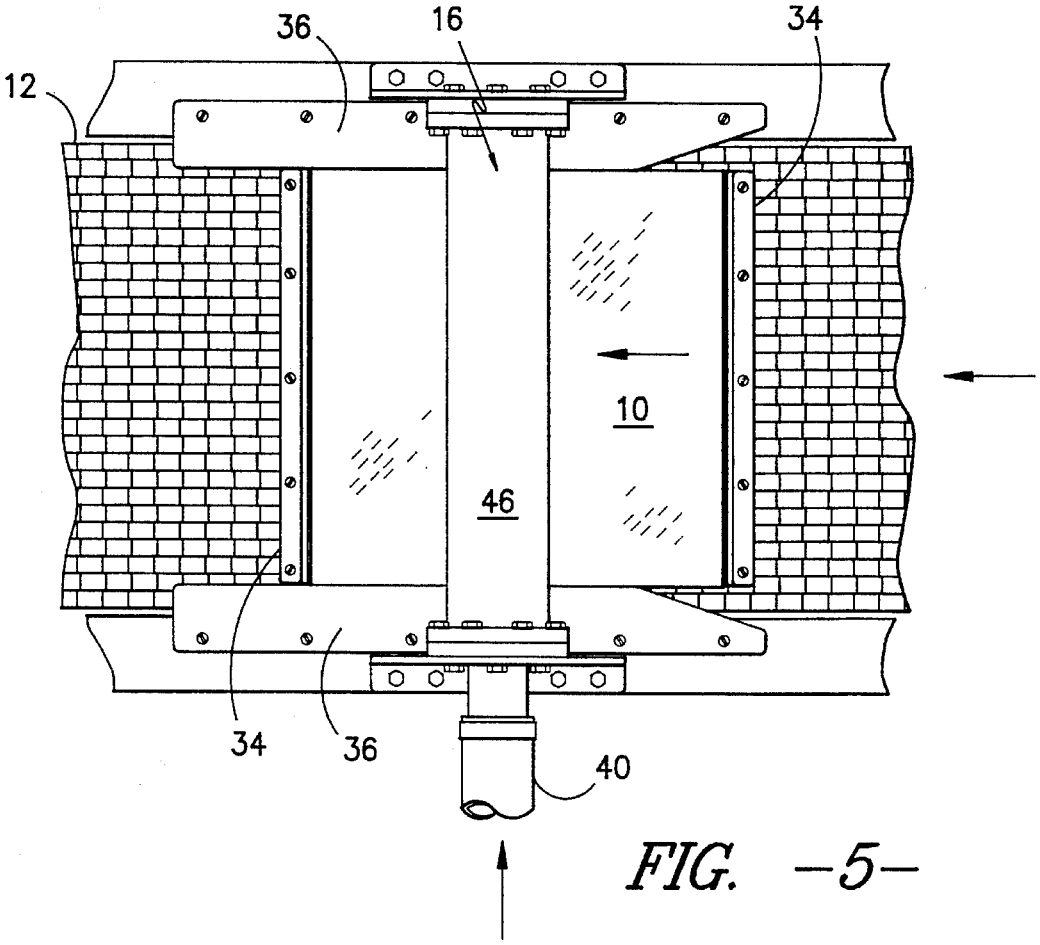
FIG. 5 is a top view taken on line 5—5 of FIG. 2.

FIG. 2 depicts an overall view of the apparatus to apply high pressure water to the carpet tiles, which is depicted as numeral 16, which is characterized in more detail in FIGS. 3 and 4. Pump 37 is used to pump, via suitable conduits 38 and 40, a working fluid such as water from a suitable source of supply 42 through an appropriate filter 44 to a high pressure supply duct 46, which in turn supplies water at suitable dynamic pressure (e.g., between 200 p.s.i.g. to 2000 p.s.i.g.) to the apparatus 16. The fluid thereby emanates from the apparatus 16 thereby striking the carpet tile 10 placed on the conveyor 12.

Looking to FIG. 3, it may be seen that the high pressure water source 16 is comprised of three basic structures: a high pressure supply gallery assembly 48 (which is mounted in operable association with the high pressure supply duct 46), slotted chamber assembly 50 and clamping assembly 52.

Supply assembly 48 constitutes an "L"-shaped member, into one leg of which is machined a uniform notch 56 which extends, uninterrupted, along the entire length of the apparatus 16. There is a rectangular uniform notch 58 which is in the other vertical leg of the "L"-shaped member 54 and adjacent to the high pressure supply duct 46. A series of uniformly spaced supply passages 60 are drilled through the rectangular uniform notch 58 and extend to the corresponding side wall of notch 56, whereby notch 56 may be supplied with high pressure water from high pressure supply duct 46, the side of which may be milled, drilled, and connected to notch 58 which is along the side wall 62 of the assembly 54. Slotted chamber assembly 50 is comprised of dual elongate "U"-shaped members 63, 65 having a rectangular cross-section therebetween. The upper "U"-shaped member 63 has a series of machined closely spaced slots which form the nozzle 18, each having a width approximately equal to the width of the desired high velocity treatment stream.

Referring now to FIGS. 3 and 4, grooved chamber assembly 50 is positioned, via clamping assembly 52, within supply gallery 54 so that its rectangular cross-section communicates via parallel spaced holes 60 to notch 56 which thereby forms both an upper and lower high pressure distribution reservoirs, respectively, so that fluid enters from a supply duct 46 and then into a high pressure distribution reservoir formed by notch 58. The water then travels via supply passages 60 into a lower high pressure distribution reservoir formed by notch 56 and then goes through holes 70 into an upper high pressure distribution chamber 72 formed by dual elongate "U"-shaped members 63 and 65. Water then flows through slots 18 towards the carpet tile 10. Clamping assembly 52 is provided along its length with jacking screws 78 as well as bolts 80 which serve to securely attach clamping assembly 52 to supply gallery assembly 48.

As shown in FIG. 4, the high pressure water source 16 is connected to the high pressure supply gallery assembly 48 by means of bolts 82 and 84 respectively. There are a series of bolts 86 which connect the lower "U"-shaped member 65 with the upper "U"-shaped member 63.

The means of eliminating dirt and mats from the carpet tiles involves the nozzles 18. In the preferred embodiment, there are forty nozzles per inch, but this can vary. Instead of having all of the slots parallel to each other, the nozzles between one lateral edge of the member 63 are at an angle from the longitudinal axis of the member 63. The angle deviation from the longitudinal axis of the member 63 that provides good results is five degrees. This angle can vary widely, with the optimal deviation angle depending on the type of fabric utilized.

As has been herein described a method and apparatus have been described which will allow dirty and matted carpet tiles to be refurbished by the treatment of high pressure water and thereby increase the service life of the carpet tiles, thereby eliminating the additional expense of purchasing new pile carpet tiles and/or rugs. It can readily be seen that the herein-described invention provides an economic saving to the user of the described method and apparatus. Furthermore, since used carpet tiles are being refurbished rather than thrown away, this invention substantially reduces the amount of carpet and carpet tiles that has to be treated in landfills and other areas of disposal, which in turn helps save our environment.

The preferred embodiment of the invention has been described and modifications of same may be made within the scope of the invention and it is therefore requested that the invention be limited by the scope of the claims.

We claim:

1. Apparatus to refurbish cut or loop pile carpet tiles comprising: a continuous elongated conveyor means, a high pressure liquid manifold mounted above said conveyor, a plurality of nozzles communicating with said manifold supplying liquid towards said conveyor means at a pressure of at least 800 p.s.i., support means on said conveyor means to accommodate the length of carpet tiles to be cleaned, means mounted adjacent said conveyor means under said liquid manifold to position a carpet tile centrally under said manifold drying means mounted in a fixed position above said conveyor means downstream from said liquid manifold to dry carpet tiles after passage under said manifold and a dye machine operably associated with said conveyor means downstream from said drying means.

2. The apparatus of claim 1 wherein a shear is mounted above said conveyor downstream of said dryer to shear the carpet tiles after passage under said manifold.

* * * * *